United States Patent [19]

Crouse

[11] 4,171,106

[45] Oct. 16, 1979

[54] METHOD OF CONTINUOUS WINDING

[75] Inventor: Jere W. Crouse, Beliot, Wis.

[73] Assignee: Beliot Corporation, Beliot, Wis.

[21] Appl. No.: 892,216

[22] Filed: Mar. 31, 1978

[51] Int. Cl.[2] ..... B65H 17/08

[52] U.S. Cl. ..... 242/66

[58] Field of Search ..... 242/66, 65, 67.1 R, 242/67.5, 68.7, 78.7

[56] References Cited

U.S. PATENT DOCUMENTS

| | | | |
|---|---|---|---|
| 1,455,976 | 5/1923 | Stevens | 242/66 |
| 1,803,043 | 4/1931 | Valentine | 242/66 |
| 2,441,439 | 5/1948 | Nelson | 242/66 X |
| 3,406,925 | 10/1968 | Waterhouse | 242/66 |
| 3,599,889 | 8/1971 | Pfeiffer | 242/66 |
| 3,837,593 | 9/1974 | Dorfel | 242/66 |
| 3,858,820 | 1/1975 | Crouse | 242/66 |
| 3,869,095 | 3/1975 | Diltz | 242/66 |
| 3,902,667 | 9/1975 | Wolf | 242/66 |
| 4,047,676 | 9/1977 | Dahl | 242/66 |

FOREIGN PATENT DOCUMENTS

| | | | |
|---|---|---|---|
| 675979 | 5/1939 | Fed. Rep. of Germany | 252/66 |
| 1083374 | 6/1960 | Fed. Rep. of Germany | 242/66 |

OTHER PUBLICATIONS

Paper Trade Journal, Dec. 11, 1967, pp. 48 through 51, Article of David A. Daly, entitled "How Paper Rolls on a Winder Generate Vibration and Bouncing".

*Primary Examiner*—Edward J. McCarthy

*Attorney, Agent, or Firm*—Hill, Van Santen, Steadman, Chiara & Simpson

[57] ABSTRACT

In a mechanism for winding a continous traveling sheet of paper, a device including first and second parallel winder drums driven in rotation in the same direction to support a roll being wound on a core supported between the drums with a rider roll on top of the roll and mechanism for laterally moving the drums apart as a function of increase in size of the roll being wound and measured by a rider roll on the roll.

10 Claims, 6 Drawing Figures

Fig. 3
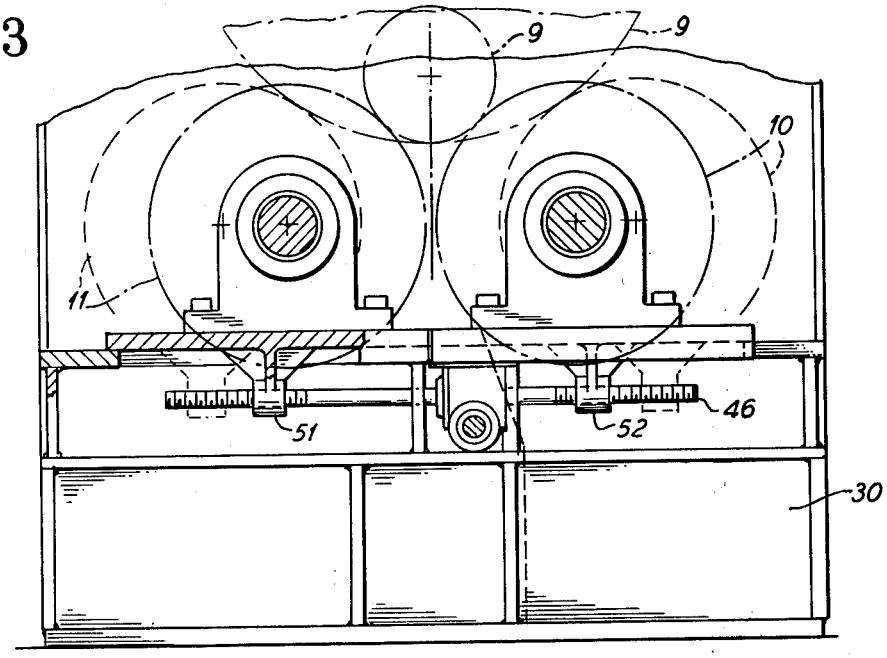
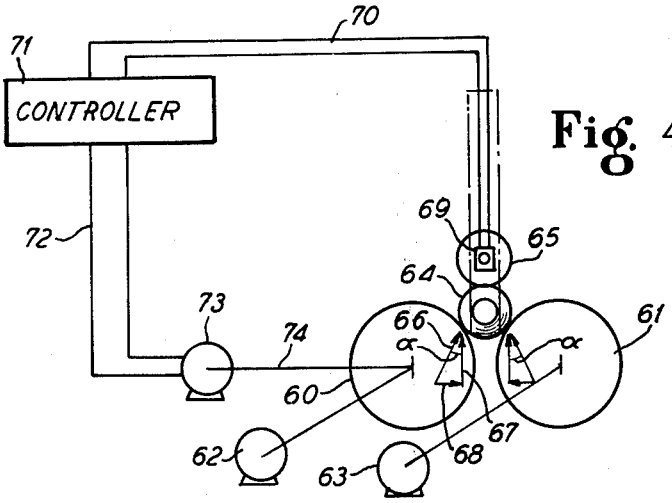
Fig. 4
Fig. 5
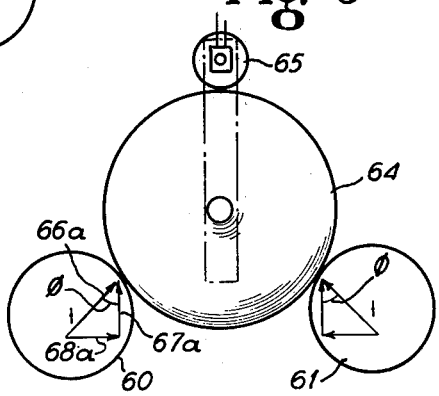
Fig. 6
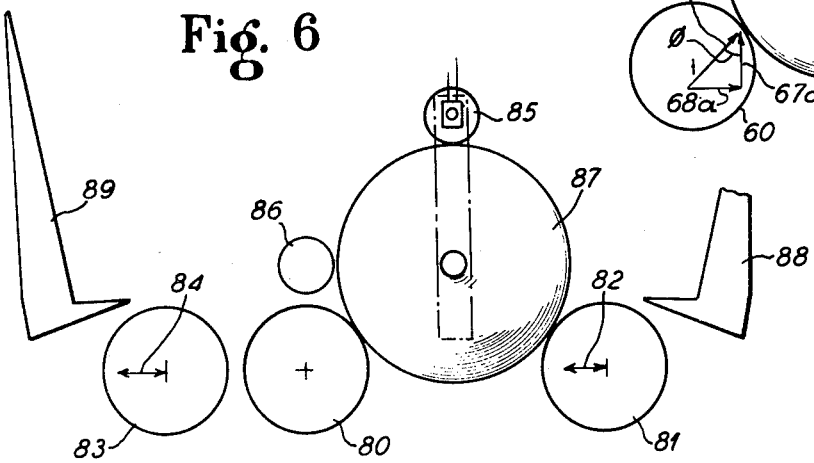

METHOD OF CONTINUOUS WINDING

BACKGROUND OF THE INVENTION

The present invention relates to improved paper web winders, and more particularly to a two drum winder wherein a roll is wound on a core and supported on driven drums with a rider roll on the roll being wound.

Winding a roll of paper on a core is a conventional operation in a paper making machine wherein the freshly made web is wound on a roll and this process is also used in converting operation wherein previously wound rolls are unwound for processing including slitting, coating and the like, and then rewound to a roll of finished size. In a paper making operation, the winding roll must be driven at the speed that the paper making machine is operated which becomes relatively high, and in a converting operation for speed of production, it is imperative that the rolls be wound at a relatively high speed. Speeds of 3,000 to 6,000 feet per minute are common, and the rolls which are wound must rotate at that peripheral speed, and as they build up in size, they possess a great deal of kinetic energy and become difficult to control.

A conventional winding structure which is used of one type is a two drum winder wherein parallel drums driven in rotation in the same direction receive a core between them with the traveling web being wound onto the core. The coaction between the supporting drums and the roll being wound, of course, changes as the roll builds up in size because the angle of contact or angle of support between the supporting drums and the wound roll changes as the roll changes in diameter, and of course, the surface pressure changes as the roll increases in size and weight. It is conventional to attempt to control the surface pressure to a degree by using a rider roll for applying a downward pressure on the roll being wound at the beginning of operation and relieving this pressure as the weight of the roll increases and at some point in the size of the roll being wound applying an upward lift on the core. The object of control of the roll being wound is to control the surface force between the winding drum and the roll being wound inasmuch as this surface force controls the tension with which the web is wound on the roll. It is, therefore, important not only to control this surface force but to maintain it constant. The constant pressure and constant effect of the drum on the roll is threatened by vibration or bounce of the roll on the drums. This bounce may occur as a straight up and down vibration of the roll, or it may occur as a rocking vibration wherein the winding roll shifts its weight from drum to drum in a rocking motion. This rocking vibration is the most difficult mode to control. It is desirable to eliminate the rocking motion, and attempts have been made to stabilize the position of the roll, and one way this can be done is to attempt to control the vibrational frequency of the bounce or rocking vibration of the roll.

It is accordingly an object of the present invention to provide an improved drum winder which is capable of winding a more uniform roll and which eliminates the undesirable effect of vibration, bounce and rocking which occurs on winders heretofore available.

A further object of the invention is to provide a two drum winder wherein the structure has additional means for controlling the forces between the drums in the wound roll thereby controlling effects of bouncing or vibration.

A further object of the invention is to provide a two drum winder wherein it is possible to change the vibration or bounce frequency and raise these frequencies outside of the speed range of the winder so that the winding of the roll will become more stable, and the web mounted thereon will be of uniform tightness throughout the circumference and uneven soft and hard spots will not occur around the circumference of the roll.

In reference to a two drum winder, it is generally meant a structure wherein two parallel supporting drums are provided which are driven in rotation for supporting a roll being wound thereon, but the structure is to include different modifications of the two drum winder and, for example, is to include a structure such as that shown in U.S. Pat. No. 3,869,095, Diltz, issued Mar. 4, 1975 wherein three drums are provided to provide two locations for winding a roll.

Other objects, advantages and features as well as equivalent structures and methods which are intended to be covered herein will become more apparent with the teaching of the principles of the present invention in connection with the disclosure of the preferred embodiment in the specification, claims and drawing, in which:

DRAWINGS

FIG. 3 is a vertical sectional view taken substantially along line III—III of FIG. 1;

FIG. 4 is a schematic view of a winder operating in accordance with the invention, with the drawing illustrating the control mechanism;

FIG. 5 is a somewhat schematic view similar to FIG. 4 and illustrating the drums in a more separated position; and FIG. 6 is a schematic view showing a three drum winder utilizing the principles of the invention.

DESCRIPTION

Figure 1:
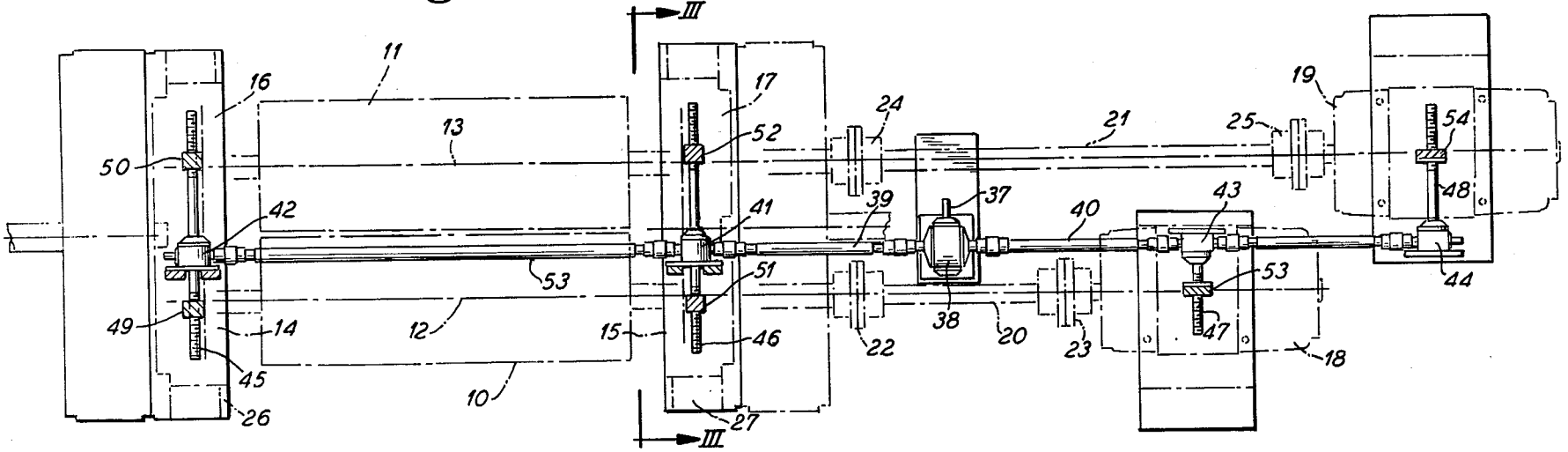
FIG. 1 is a top plan view shown somewhat in schematic form of a two drum winder constructed and operating in accordance with the principles of the present invention.
Figure 2:
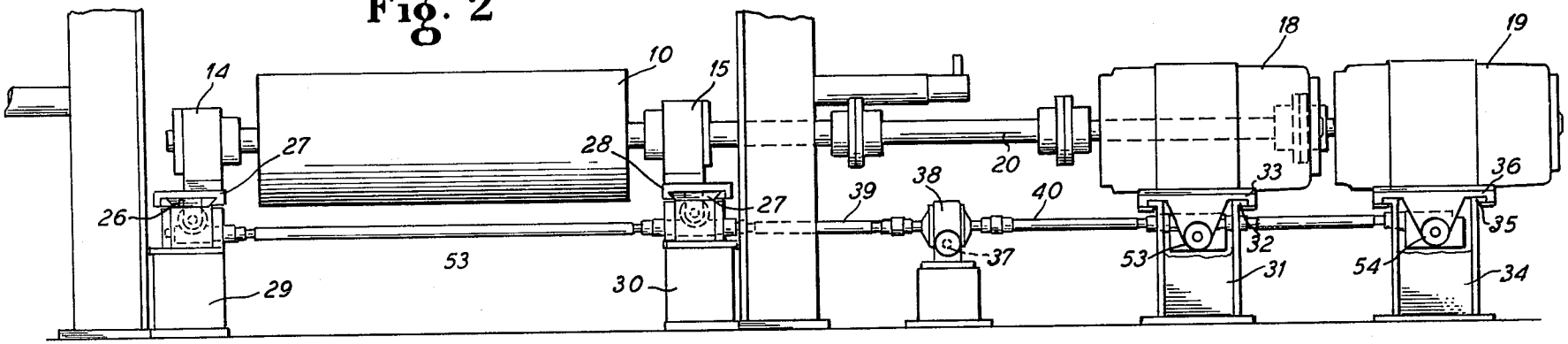
FIG. 2 is a front elevational view of the mechanism of FIG. 1.

As illustrated in FIGS. 1 through 3, a two drum winder is shown having cylindrical parallel drums 10 and 11, which are driven in rotation in the same direction to support a roll being wound thereon. The position of the roll being wound is shown somewhat schematically at 9 in FIG. 3.

The drums are positioned at equal elevations so that they provide vertical support to the roll 9 being wound, and the drums rotate on axes 12 and 13. The drums have shafts at the ends which are journalled in bearings shown at 14 and 15 for the drum 10 and shown at 16 and 17 for the drum 11.

The drums are each driven in rotation at an equal speed for driving the roll in rotation. For this purpose, the drum 10 is driven by a motor 18 and drum 11 is driven by a motor 19. The motor 18 drives the drum 10 through a shaft 20 with flexible connections 22 and 23 connected in the shaft between the motor and drum. Similarly, motor 19 drives the drum 11 through a shaft 21, and flexible connectors 24 and 25 lead between the motor and drum 11. The motors are offset slightly axially from each other as illustrated in FIGS. 1 and 2 for the purposes of space to permit the drums to be moved close to each other without the motors interfering.

An important feature of the invention is the mounting of the drums so that they can shift laterally relative to each other so that the spacing between their axes 12 and 13 can be increased as the size of the roll being wound is increased. In order to maintain the motors and drive shafts in alignment and permit continuing to drive the drums as this lateral spacing changes, each of the structures, that is the bearings for the drums and the mounts for the motors, are mounted on horizontal slides, and a horizontal positioning arrangement is provided to move the motors laterally simultaneously with the drums.

While the drums are so constructed so that they are moved together or apart by both being moved simultaneously, it will be understood that in some instances either drum may be positioned stationary while the other drum is moved relative thereto. Moving both drums simultaneously is advantageous in avoiding the necessity of moving other structures which are centrally located relative to the drum such as a rider roll which is positioned above the roll being wound.

The bearings 14 and 16 at one end of the drums are mounted upon a stand 29 on the floor, and the bearings 15 and 17 at the other end of the drums are mounted upon a floor stand 30. The stand 29 has a horizontal track 26 thereon, and the stand 30 has a horizontal track 27 thereon. The bearings are mounted on slides on these tracks so as to be able to slide horizontally, and the tracks are parallel for this purpose. As illustrated in FIG. 2, the bearing 14 has a slide 27 which is mounted on the track 26 with a gib mounting, and the bearing 15 is supported on a slide 28 on the track 27. The bearings for the other drum 11 are mounted on similar slides.

The motors 18 and 19 are provided with floor stands 31 and 34 which have horizontal tracks 32 and 35 at their tops. Slides 33 and 36 for the motors 18 and 19 respectively are provided to slide horizontally on the tracks.

To control the position of the drums and slide them apart horizontally, a power operated drive shaft 37 is provided driven by a control motor, not shown. The drive shaft 37 leads into a worm gearing 38 which drives output shafts 39 and 40. These shafts lead horizontally to worm gear boxes 43 and 44 for the motors 18 and 19 respectively. The shaft 39 leads to worm gear boxes 41 and 42 for the drums. The gear boxes 41 and 42 rotate laterally extending threaded rods 45 and 46. These rods are threaded into downwardly projecting brackets shown at 49 and 50 for the rod 45, and shown at 51 and 52 for the rod 46. The brackets are threaded, and as illustrated in FIG. 3, with rotation of the drive, and rotation of the rod 46, the brackets will be forced apart or together to control the position of the bearings and thereby control the spacing between the drums 10 and 11. For the motors, similar threaded rods shown at 47 and 48 lead into downwardly projecting threaded brackets 53 and 54 to simultaneously move the motors laterally when the drums are moved.

When a roll begins winding, the drums are positioned close together in the position shown in FIG. 3. As the roll increases in size, the drums are progressively moved apart as a function of the size of the roll being wound, until they are rather widely spaced as illustrated in the schematic drawing of FIG. 5. By separating or moving the supporting drums apart, the force between the drum and the roll being wound is varied to vary the bouncing effect of the roll and the drums. For a roll of a given size, as shown by the roll 64 in FIGS. 4 and 5, the difference in the relationship between the support drums and the roll is shown by the force arrows 66 in FIG. 4 and **66*a* in FIG. 5. In these figures the supporting drums are shown at 60 and 61 driven by drive motors 62 and 63. A positioning motor 73 is shown with a positioning shaft 74** which operates to move the drums together or apart.

In the diagram of FIG. 4, the arrow 66 which is normal to a tangent line drawn between the drum 60 and the roll 64 makes an angle alpha with a vertical line 67. 67 is the line which represents the vertical force vector or vertical force which supports the roll. The arrowed line 68 represents the horizontal force vector which is the force which tends to prevent the winding roll 64 from moving out of the winding nest or nip formed between the drums 60 and 61. As the supporting drums 60 and 61 are spread to the position of FIG. 5, it will be seen that the force vector **66*a* moves to a much more horizontal position making an angle $\phi$ larger than angle $\alpha$ of FIG. 4 with the vertical force vector 67*a*. For rolls of the same size, the vertical vectors 67 and 67*a* are the same. Thus, the horizontal forces 66 and 66*a* will be considerably larger as the rolls are separated. Also, the horizontal vector 68*a* will become considerably larger as the roll increases in size. Thus, the effect between the drum and the roll being wound is different as the drums are separated and increased horizontal forces tend to dampen the roll vibration, changing their amplitude and frequency. By control of the spacing between the drums 60 and 61, the amplitude and frequency can be controlled so that adverse effects of bouncing will disappear. The spacing between the drums will be varied in accordance with the weight and size of the roll being wound, but of course, will also be varied in accordance with the type of paper being wound, the tension at which the roll is wound, the speed of winding, and other factors. This spacing can be predetermined and controlled in accordance with the size of the roll being wound. The size can be determined by the diameter or by the weight, and because a conventional arrangement utilizes a rider roll 65 on top of the roll being wound, this can be used to provide a reading of size. The end of the rider roll is connected to a control 69 having an electrical output which is supplied to electrical leads 70 to a control unit 71. The control unit is programmed to send a signal to the positioning motor through leads 72 so that the space in between the drums 60 and 61 is controlled as a function of the position of the rider roll 65 and hence of the size of the roll 64** being wound.

FIG. 6 illustrates a three drum winder somewhat similar in construction to that disclosed in the aforementioned U.S. Pat. No. 3,869,095. In this winder first and second drums 80 and 81 are shown supporting a roll being wound 87. The second drum 81 moves laterally relative to the first drum 80 which is in a fixed position. A rider roll 85 is on top of the roll being wound, and when winding is completed, a push roll 86 moves laterally against the roll being wound to push the roll into receiving arms 88. When this roll is completed, a new roll is formed between the first and third rolls 80 and 83. The third roll is moved laterally away from the first roll by positioning mechanism shown schematically by the double arrowed lines 84. Similarly, the second roll is controlled and positioned by suitable mechanism indicated schematically by the double arrowed lines 82. When a roll is completed which is formed in the second position between the drums 80 and 83, it is pushed out of its position by the push roll 86 into support arms 89.

Thus, it will be seen that we have provided a winder which meets the objectives and advantages above set forth and provides an improved more uniformly wound roll.

I claim as my invention:

1. In a winder for winding a continuous traveling web of sheet material onto a core, the combination comprising:

first and second winder drums positioned in parallel side-by-side relationship rotatable on parallel horizontal axes for providing vertical support for a winding roll of sheet material and arranged to rotate in the same direction;

support means for said drum accommodating relative movement of the axes for changing the lateral spacing of the drums;

a rider roll centrally mounted above said winder drums for vertical movement relative thereto;

electronic sensing means carried on said rider roll to monitor the size of a roll being wound;

and drum positioned means controlled by said sensor means for moving said rolls continuously laterally apart at adjustable speed as a function of increase in size of the roll being wound for reducing the amplitude of bounce of the roll being wound and affecting the frequency of bounce for improved winding.

2. In a winder for winding a continuous traveling web of sheet material onto a core constructed in accordance with claim 1, the combination:

wherein said first drum rotates on a fixed axis and said second drum has its axis movable away from the first drum with said drum positioning means moving the second drum.

3. In a winder for winding a continuous traveling web of sheet material onto a core constructed in accordance with claim 1, the combination:

including first and second rotational drives respectively connected to said drums for driving the drums in rotation.

4. In a winder for winding a continuous traveling web of sheet material onto a core constructed in accordance with claim 1;

wherein the structure includes a rotational drive for said second winder drum driving it in rotation and wherein said support means accommodates movement of the second drum away from the first and said drive is movable with the drum.

5. In a winder for winding a continuous traveling web of sheet material onto a core constructed in accordance with claim 1:

including means for measuring the size of a roll being wound supported by said drums and connected to said drum positioning means and operative to increase the spacing between the drums as a function of increase in roll size.

6. In a winder for winding a continuous traveling web of sheet material onto a core constructed in accordance with claim 1;

including a rider roll resting on the roll being wound with means for measuring the size of the roll being wound as a function of movement of the rider roll and connected to said drum positioning means for increasing the spacing between drums as a function of rider roll position.

7. In a winder for winding a continuous traveling web of sheet material onto a core, the combination comprising:

first and second winder drums positioned in parallel side-by-side relationship rotatable on parallel horizontal axes for providing vertical support for a winding roll of sheet material and arranged to rotate in the same direction;

support means for said drums accommodating relative movement of the axes for changing the lateral spacing of the drums;

a third winder drum positioned at the side of said first drum opposite the second drum with rolls being sequentially wound between said first and second drums and then between said first and third drums with said second and third drums being movable laterally away from said first drum and said drum position means operative to control the position of said second and third drums independently of each other and away from said first drum;

and drum positioning means moving said rolls laterally apart as a function of increase in size of the roll being wound for reducing the amplitude of bounce of the roll being wound and affecting the frequency of bounce for improved winding.

8. In a winder for winding a continuous traveling web of sheet material onto a core constructed in accordance with claim 7:

including a lateral push roll for engaging the side of a roll being wound and forcing the roll laterally over the second roll or alternately laterally over the third roll.

9. The method of winding a continuous traveling web of sheet material onto a core, comprising the steps:

providing first and second winder drums positioned in parallel side-by-side relationship on parallel horizontal axes for providing vertical support for a first winding roll of sheet material and rotating the drums in the same direction to completely wind said first roll;

moving said second drum laterally apart from said first drum as a function of increase in size of the roll being wound supported on the drums reducing the amplitude of winding roll bounce and affecting the frequency of bounce for improved winding;

pushing said first wound roll onto a first pair of support arms;

providing a third winder drum positioned at the side of drum opposite said second drum for vertical support for a second winding roll of sheet material and rotating said first and third drums in the same direction to completely wind said second roll;

moving said third drum laterally apart from said first drum as a function of increase in size of said second roll; and pushing said second wound roll onto a second pair of support arms.

10. The method of winding a continuous traveling web of sheet material onto a core in accordance with the steps of claim 9;

including moving the drums apart as a function of increase in diameter of the roll being wound.

* * * * *